United States Patent [19]

Barlow

[11] 4,004,765

[45] Jan. 25, 1977

[54] BRIDGE ACCESSORY FOR TRACK VEHICLES

[75] Inventor: Gordon A. Barlow, Evanston, Ill.

[73] Assignee: Marvin Glass & Associates, Chicago, Ill.

[22] Filed: Feb. 9, 1976

[21] Appl. No.: 656,113

[52] U.S. Cl. ..... 246/118; 104/129

[51] Int. Cl.[2] ..... B61L 23/04

[58] Field of Search ..... 246/111, 118, 119, 112, 246/143, 146, 489, 486; 104/131, 129; 14/36, 37, 38, 40, 42, 49

[56] References Cited

UNITED STATES PATENTS

| | | | |
|---|---|---|---|
| 486,738 | 11/1892 | Rohlf | 14/49 |
| 908,713 | 1/1909 | Waddell | 14/40 |
| 1,905,571 | 4/1933 | Smith | 104/129 |
| 2,256,862 | 9/1941 | Duffy | 246/119 |
| 2,366,848 | 1/1945 | Ferri | 14/36 |

*Primary Examiner*—Trygve M. Blix
*Assistant Examiner*—Reinhard J. Eisenzopf
*Attorney, Agent, or Firm*—Coffee and Sweeney

[57] ABSTRACT

An accessory bridge for use with a model train set, a model car race set, or the like, wherein the vehicles traverse a path of travel defined by a specific track layout. Particularly, the bridge accessory is designed for use with a track layout having a cross-over point where one segment of the track crosses over another segment, such as a "figure 8" configuration layout. The bridge accessory includes a pivotally mounted bridge portion which supports the upper or cross-over track segment at an elevated height above the lower or cross-under track segment. The bridge is movable by a selectively actuatable drive unit between a down position where a vehicle may pass over the bridge and an up position where a vehicle may pass under the bridge. It is contemplated that the bridge be used with a model set where the vehicles derive their power directly from the track and includes a safety interlocking electrical circuit directly in the track segments so that a train or car is energized and can only pass over the bridge when in its down position and can only pass under the bridge when in its up position. An alarm is activated to produce an audible warning when the pivotal portion of the bridge is in motion.

6 Claims, 10 Drawing Figures

10
12
14
16
18
20
26
28
34
36
40
43
44
48
50
52
54
56
82
102
104
142
144
146
150
3
4

BRIDGE ACCESSORY FOR TRACK VEHICLES

BACKGROUND OF THE INVENTION

1. Field of the Invention

This invention relates to accessory items for model trains or the like and in particular provides a bridge accessory therefor.

2. Description of the Prior Art

Accessories for model train sets, car race sets, and the like, have been manufactured and sold to give realism to a layout for these hobby items. Such accesories have included train stations, automatic crossing gates, signal lights and other items to simulate real life situations. Many of the items, such as automatic crossing gates are actuated by sensors such as an electric eye, on either side of the crossing to automatically close the gate as the model train passes the crossing.

SUMMARY OF THE INVENTION

An object of the present invention is to provide a new accessory bridge for use with a model train or the like which permits a train to pass over the bridge when in a first, down position and pass under the bride when in a second up position.

In accordance with this and other objects, the accessory bridge of the present invention includes a frame structure having a pivotally mounted drawbridge-type portion for movement between an up position so that the train may pass under the bridge and a down position so that the train may pass over the bridge. A selectively actuatable drive means is provided for moving the bridge between its respective positions and a circuit means is provided to interchangeably de-energize the power supply to the vehicle to prevent an accident so that a train cannot pass over the bridge when in its up position or under the bridge when in its down position. Switch means, interconnected between the movable bridge portion and the circuit means, switches the circuit means between its respective positions as determined by the position of the movable bridge portion. An alarm or warning signal is activated whenever the movable bridge portion is in motion to indicate that the bridge or underpass cannot be traversed.

DESCRIPTION OF THE PREFERRED EMBODIMENT

Figures 1, 2, 3:
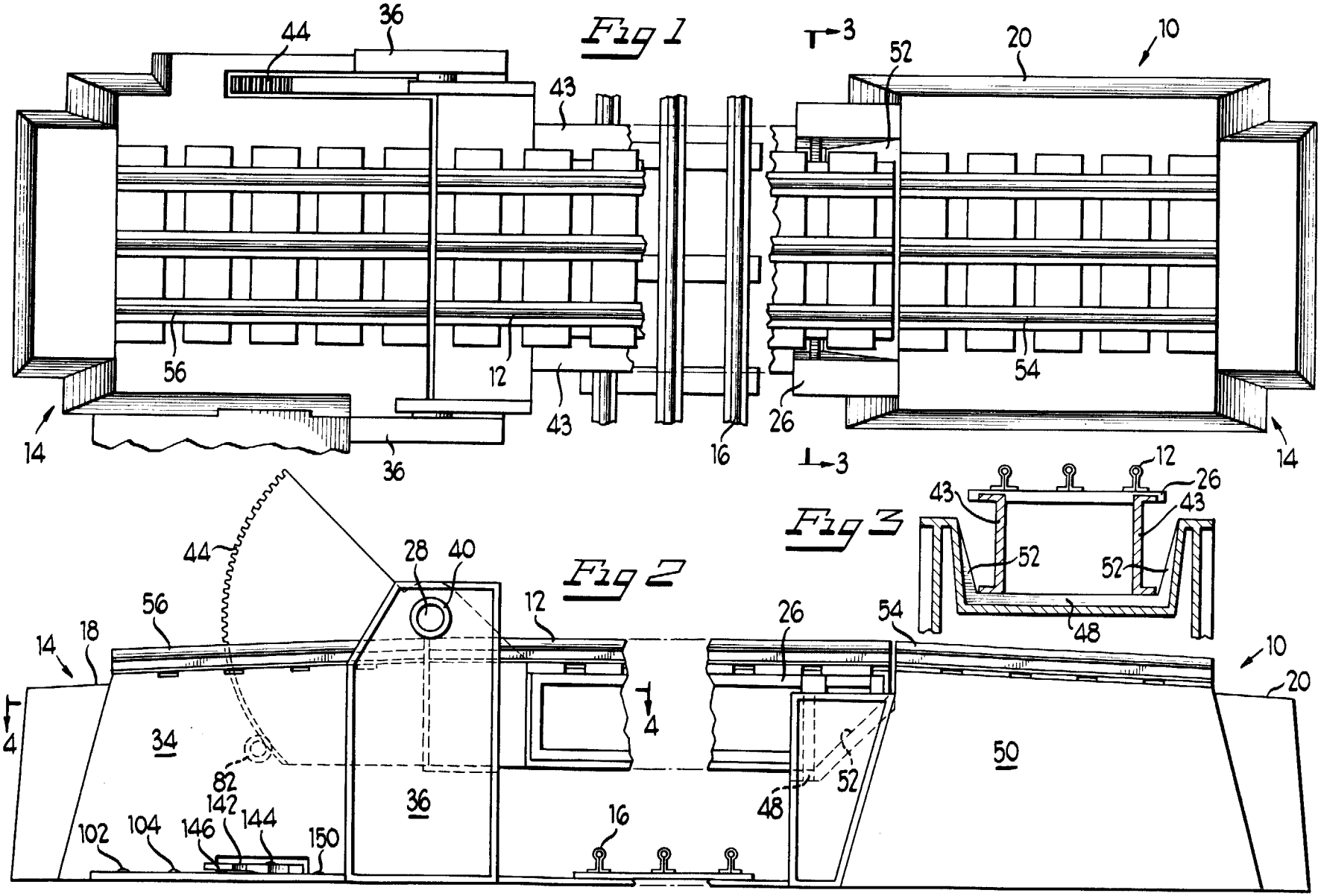
FIG. 1 is a partially fragmented, top plan view of a train accessory made in accordance with the concepts of the present invention.
FIG. 2 is a partially fragmented, front elevational view of the train accessory bridge of FIG. 1.
FIG. 3 is a vertical section taken generally along line 3—3 of FIG. 1.

An accessory bridge, generally designated 10, for use with a model train, embodying the concepts of the present invention, is shown in FIGS. 1 and 2. The bridge 10 is a "drawbridge"-type bridge and is designed particularly for use with a model train track layout having a cross-over point in the path of travel such as a FIG. 8 configuration or the like. The bridge 10 elevates an upper track segment 12 by a frame, generally designated 14, above a lower track segment 16 so that the model train may pass over or under the bridge 10 thus eliminating the need for a specially designed "cross" piece of track segment. The bridge accessory 10 also is designed to induce participation of the user of the model train assembly and requires the user to raise and lower the bridge during its respective passes.

Figure 5:
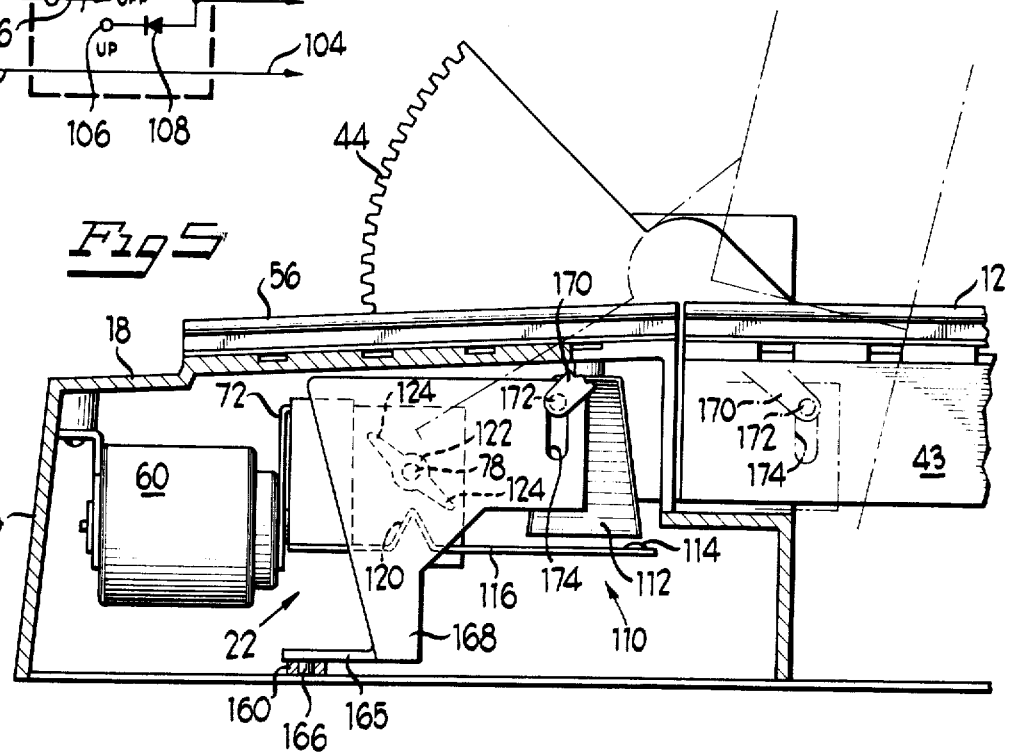
FIG. 5 is a fragmented vertical section, taken generally along line 5—5 of FIG. 4.
Figure 6:
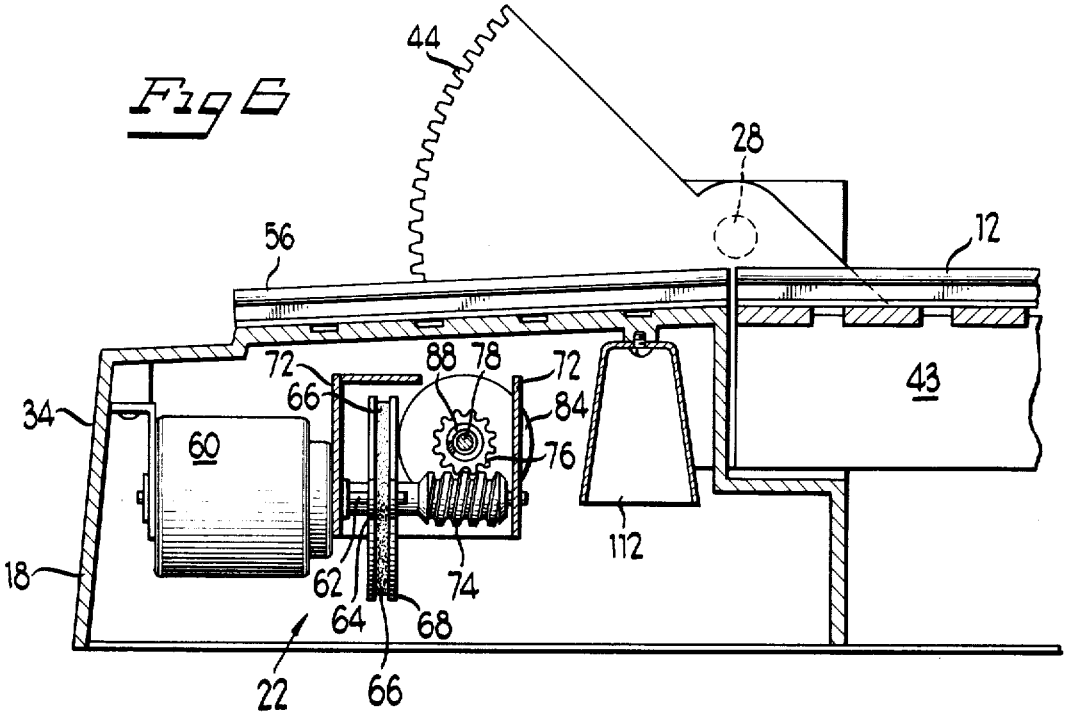
FIG. 6 is another vertical section taken generally along line 6—6 of FIG. 4.

The base 14 is provided in two segments: a power-base segment 18 and a support-base segment 20 as seen in the left and right portions of FIGS. 1 and 2, respectively. The power-base segment 18 of the base includes a drive means, generally designated 22 (FIGS. 4, 5, 6 and 7), which is selectively manually actuated to raise and lower the bridge. A bridge span 26 is pivotally mounted by a shaft 28 to the power-base segment 18 so that it can be pivoted from a "down" position as shown in FIGS. 1, 2, 6 and in solid lines in FIG. 5, to a raised or "up" position as shown in phantom in FIG. 5.

Figure 9:
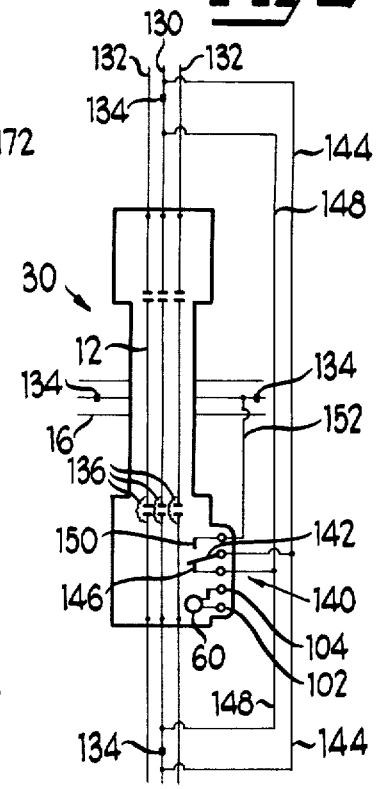
FIG. 9 is a schematic, electrical diagram of the circuit means of the present invention.

A safety interlocking circuit means, generally designated 30, is shown schematically in FIG. 9. In conventional model train systems, the electrical power for the model train is transmitted through electrically conductive track segments where at least one rail serves as a power supply rail and another rail serves as a ground or return route. The circuit means 30 is interconnected to the track segments 16 and 12 adjacent the bridge 10 so that power is alternately supplied to only one of the segments, the upper cross-over 12 or the lower underpass segment 16. As will be described in detail hereinafter, the upper track segment 12 is energized only when the bridge is in its down position, and the lower track segment is energized only when the bridge is in its up position to prevent the train from travelling off of the track on the top or colliding with the bridge span portion 26 underneath.

Referring more particularly to FIGS. 4 through 7, the power-base portion 18 includes a generally rectangular housing structure 34 which substantially closes the drive means 22 therein. The housing 34 includes an upstanding pair of cantilever support arms 36 for pivotally mounting the bridge span 26. The support arms 36 are strengthened by a peripheral flange 38. A similar generally centrally located circular flange 40 provides a journal bearing for the pivotal mounting stub shafts 28 on either side of the bridge span. The shafts 28 are connected by a bridge span frame member 42 which includes two I-beam sections 43 on either side of the bridge span 26. An arcuate gear rack 44 is connected to or integrally molded with the bridge frame member 42 for engagement with the drive means 22 to pivotally raise and lower the bridge. When in the down position, the free end of the bridge span 26 and I-beam sections 43 are supported by a generally U-shaped cradle 48 provided on the support base 20. The support base 20 includes a generally hollow, rectangular housing 50. The cradle 48 is defined in the housing 50 by a plurality of generally downwardly canted wall portions 52. The bridge span portion 26 extends past the free end of the I-beam sections 43 so as to properly align with a downwardly sloping track segment 54 mounted on the top of the support-base portion 20. This track segment 54 then is connected to the remaining portion of the track layout configuration. A similar, slightly canted track segment 56 is mounted on the top of the power-base portion 18 to align with the pivoted end of the upper track segment 12.

The drive means 22 is manually actuated by the user to raise and lower the bridge span 26. More particularly, referring to FIGS. 4 through 7, the drive means includes a motor 60 mounted on the base. The motor 60 includes a shaft 62 and a pulley 64 on the end thereof which drives a belt 66 connected to a larger pulley 68. The larger pulley 68 is rotatably mounted by a shaft 70 in a generally rectangular inner frame 72 within the housing 34. The shaft 70 carries a worm gear 74 for conjoint rotation with the larger pulley 68 as the motor 60 is energized. The worm gear 74 engages a biased output gear 76 which rotates at a substantially slower speed than the worm gear 74. The output gear 76 is rotatably mounted on a generally horizontal shaft 78 which itself is rotatably mounted by the inner frame 72. The shaft 78 is securely connected to a pinion gear 82 which is in constant engagement with the arcuate rack 44.

A pair of clutch plates 84 and 86, between the pinion gear 82 and the output worm gear 76, drivingly connects the output gear 76 with the pinion gear 82. A clutch disc or washer 87 is rotatably mounted on the shaft 78 between the clutch plates 84 and 86. A coil spring 88, wrapped about the shaft 78, urges the clutch plate 84 into engagement with the clutch plate 86. However, if the motor is energized or maintained energized when the bridge span 26 reaches a terminal position either in the up or down position, the clutch will slip to prevent damage to the drive means. The slippage is possible because the plate 84 can move relative to the shaft 78 against the force of its biasing spring 88 to permit slippage between the respective clutch portions 84 and 86 so that the motor 60 will not be damaged.

Figure 10:
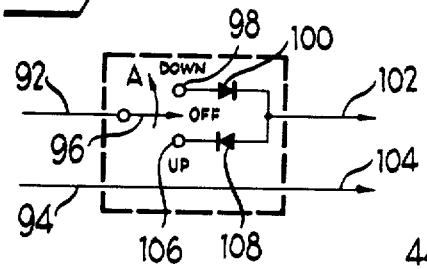
FIG. 10 is a schematic, electrical diagram of the control switch of the present invention.

The motor 60 preferably is a DC motor and thus capable of rotation in either direction for raising or lowering the bridge. FIG. 10 schematically illustrates the manually actuatable switch 90 for the drive means motor 60. The switch 90 utilizes an AC voltage sufficient to drive the motor 60, for example 5 volts AC, connected to its input leads 92 and 94. The input lead 92 is connected to a three-position movable contact 96. As shown in FIG. 10, the contact 96 is at an intermediate or neutral position and no power is being transferred to the motor 60. When moved upwardly, generally in the direction of arrow A, the contact 96 engages a down contact 98 which is connected through a rectifier or diode 100 to the output leads 102 and 104 to cause the motor to rotate in one direction which will pivot the bridge span 26 downwardly by rotating the pinion gear in a counterclockwise direction as shown in FIGS. 5 and 6. The rectifier or diode 100 provides a positive output voltage to the motor 60. Conversely, when the movable contact 96 is rotated opposite arrow A in engagement with an up contact 106, a second rectifier or diode 108 provides a negative voltage to the output terminals 102 and 104 to the motor 60 to cause the bridge span to raise as the pinion gear rotates in a clockwise direction as shown in FIGS. 5 and 6.

Thus, the bridge span 26 can be either raised or lowered by the user simply by moving the contact 96 to either its up or down position. The clutch, including the clutch plates 84 and 86, provide a safety feature and prevents damage to the motor and drive train in the event the contact 96 is left in either the up or down position after the bridge has reached its terminal up or down position or in the event the contact 96 is moved to an incorrect position for moving the bridge span 26. It also is contemplated than an automatic sensor such as a conventional photo cell, weight sensor or the like could be utilized to operate the drive means 22 without departing from the concepts of the present invention.

Figure 7:
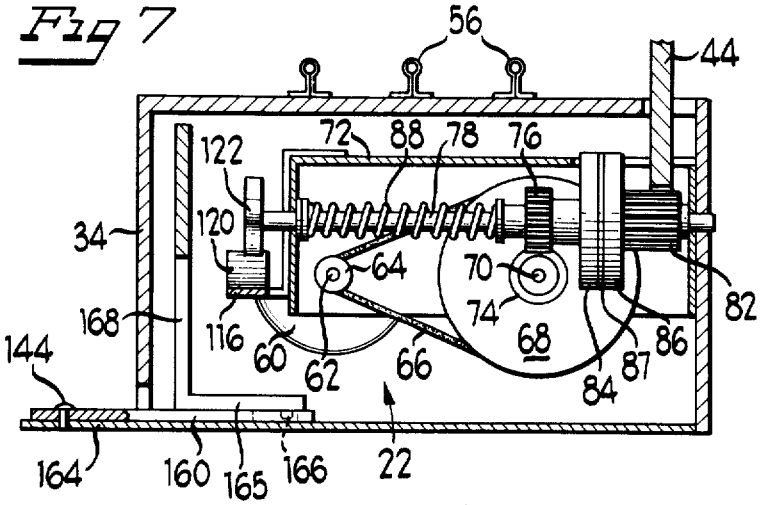
FIG. 7 is another vertical section taken generally along the line 7—7 of FIG. 4.

A sounding means, generally designated 110 (FIG. 5), is actuated whenever the bridge span 26 is moving between its terminal up and down positions. The sounding means includes a bell 112 mounted on the interior of the housing 36 adjacent a hammer 114. The hammer 114 is mounted by a flexible leaf-type spring 116 to the side of the inner frame 72. The flexible spring 116 includes a cam surface 120 which is generally vertically aligned below the shaft 78. The free end of the shaft, as shown in the left of FIG. 7, carries a second cam 122 for rotation therewith. The cam 122 includes a pair of lobes 124 which alternately contact the cam 120 of the leaf spring 116 as the shaft 78 rotates to cause the cam of hammer 114 to strike the bell 112 of the sounding means or alarm as the shaft 78 rotates. Of course, when the drive means 60 is not energized or when the bridge is in either of its terminal positions, the shaft 78 will not rotate and therefor the alarm will not be actuated.

As previously described, the circuit means 30 is designed to interlock the rail power system to prevent a collision. The design of the bridge is such that the bridge span support I-beam sections 43 extend downwardly in proximity to the lower track segment 16 such that there is not enough room for a model train to pass under the bridge. Therefore, the bridge must be raised to permit a model train to pass through the underpass.

The circuit means 30 is designed to prevent a collision during an underpass of the train and to prevent the train from attempting to cross the bridge when the bridge span 26 is in its up position. The circuit means 30 is designed and shown with respect to a three-track train system, such as 0.027 gauge model trains, but is equally applicable to a two-track system. In a three-track system, an electrically conductive center rail 130 carries power to the motor of the model train. The two outer rails 132 serve as return leads to a power transformer. As currently contemplated, the center rail 130 of the track segment 12 crossing the bridge and of the track segment 16 passing under the bridge are insulated by suitable insulators 134 so that they are not electrically connected to the adjacent center rail portion.

A plurality of flexible connectors 136 span the pivotal end of the elevated track segment 12 with the adjacent track segment 56 to provide electrical conductivity therebetween.

An interlock switch means, generally designated 140, is provided on the power-base portion 18 to alternately energize the insulated center track portions on the upper and lower bridge track segments 12 and 16. Particularly, the switch 140 includes a movable contact 142 whcih is connected by a lead 144 to the center track 130 outside of the insulators 134 so that it is constantly energized with electrical power. The movable contact 142 is a break-before-make switch and is moved by the drive means 22, as will be described in detail hereinafter. The contact 142 is movable to one of two positions. As shown in FIG. 9, the contact 142 is in its down position in engagement with a stationary contact 146. The contact 146 is connected by leads 148 to the insulated center track 130 of the upper track segment 12 so that in this position the upper track 12 is energized and the train may pass over the bridge 10. In its second position (FIG. 8), the movable contact 142 engages a second stationary contact 150 which is connected by a lead 152 to the insulated center track of the lower track segment 16 so that the train may pass under the bridge. This second position is the up position for the switch 140 and the contacts 142 and 150 are made when the bridge is in its up position. Thus, it can be seen that the train can pass under the bridge only when the switch 142 engages the down contact 146.

Figure 4:
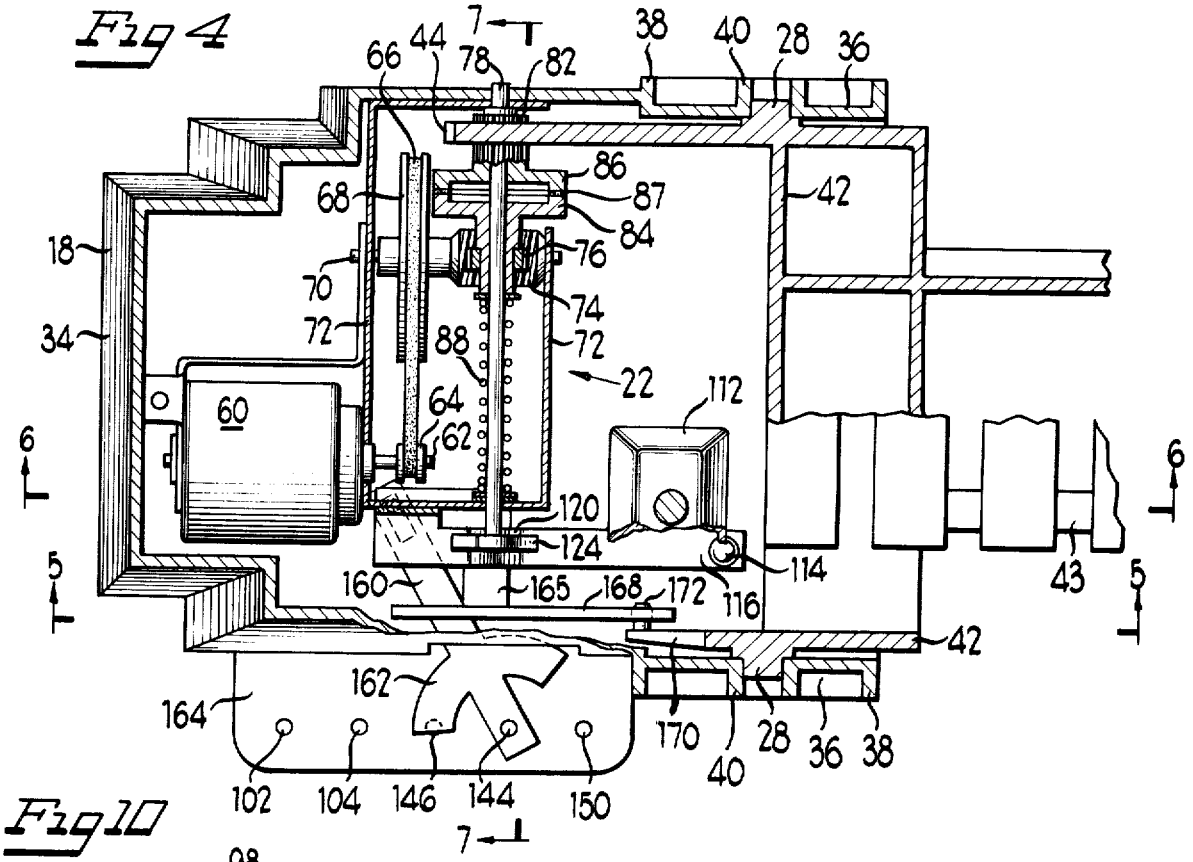
FIG. 4 is a partially fragmented, horizontal section taken generally along line 4—4 of FIG. 2.
Figure 8:
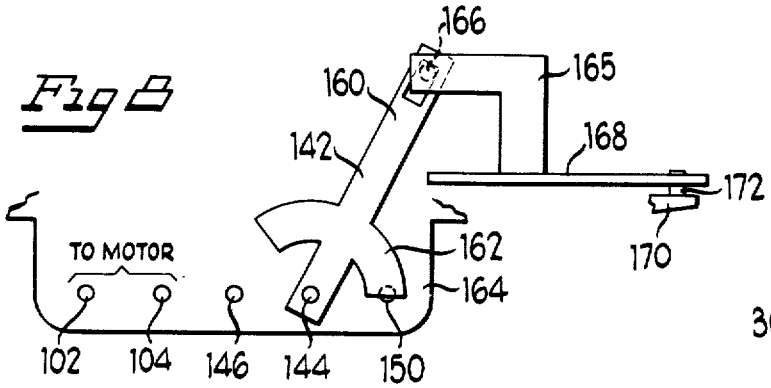
FIG. 8 is a fragmented top plan view of the switch means of the present invention.

The control switch means 140 is interconnected with the movable bridge span 26 so as to automatically move the movable contact 142 to preset the circuit means 30 for energization of the respective upper or lower track portions 12 or 16 according to the condition of the bridge span. As shown in FIG. 8, the movable contact 142 includes a pivotally mounted arm 160 and an arcuate contact rib 162 which connects either the up contact 150 with the lead 144, as shown in FIG. 8, or the down contact 146 with the lead 144, as shown in FIG. 4. The arm 160 is pivotally mounted on a generally horizontal plate 164 extending outwardly from the side of the housing 34. The horizontal plate 164 includes five electrical connectors, such as screw-type connectors, alligator clips, or the like, for connecting the lead wires for the respective circuits. The lefthand connectors 102 and 104 are connected to the output lead from the switch 90 and to the motor 60 and, therefore, are similarly numbered. The three righthand most connectors 146, 144 and 150 represent the down contact 146, the up contact 150 and the power lead 144 which is connected to the central power rail 130. A control arm 165 is slidably and pivotally connected at the inner, free end of the arm 160 by a slip pin or rivet 166. The control arm 165 is carried by a generally vertical, pivotal plate 168 which reciprocates in order to pivot the movable contact 142. A control lever 170 is connected to or molded integrally with the bridge span support frame 42 to slidably engage the vertical plate 168. A pin 172 on the end of the control lever 170 slidably engages a vertical slot 174 in the plate 168 to move the plate between its down position as shown in solid lines in FIG. 5 to its up position as shown in phantom in FIG. 5 as the movable bridge span portion 26 moves between its down and up positions.

The above-described linkage, therefore, always will maintain the control arm 165 and thus the movable contact 142 in the proper position engaging the corresponding up or down contacts 146 and 150 to properly energize the track segment 12 on top of the bridge or the track segment 16 which passes underneath the bridge.

The foregoing detailed description has been given for clearness of understanding only and no unnecessary limitations should be understood therefrom as some modifications will be obvious to those skilled in the art.

I claim:

1. A bridge accessory for use with a model vehicle set having an electrically conductive track layout for defining a path of travel and supplying power to the model vehicle, and including at least one cross-over point in the track layout, comprising:

a frame structure at the cross-over point;

a bridge portion including a movable track segment pivotally mounted on the frame, said bridge portion being movable between a down position where the model vehicle may pass over the bridge portion and an up position where the model vehicle may pass under the bridge portion;

a selectively operable drive means connected to the movable bridge portion and a power supply for selective movement of the bridge portion between its respective up and down positions, said bridge portion having an arcuate gear rack adjacent the pivoted end thereof and said drive means includes a pinion gear in engagement with said gear rack for moving the bridge portion between its up and down positions by rotation of said pinion gear in a predetermined direction;

circuit means operatively connected to said bridge portion including at least one power supply rail and at least one ground rail on the track and insulation means for a first power supply rail segment of predetermined length on the track segment on the movable bridge portion and a second power supply rail segment of predetermined length on the track layout under the cross-over point for insulating said first and second power supply rail segments from the remainder of the track layout power supply rail, said circuit means being connected to said power supply for alternately connecting the first insulated power rail segment on top of the movable bridge portion with the power supply when the bridge is in its down position and the second insulated power supply rail segment under the cross-over point with the power supply when the bridge is in its up position; and sounding means connected to said drive means for producing an audible signal when the bridge portion is in motion, said sounding means including a bell and a movable hammer adjacent said bell and cam means associated with said hammer and the drive means for causing the hammer to strike the bell as the drive means is energized.

2. The accessory of claim 1 including mechanical stop limit means defining the up and down positions of the movable bridge portion and wherein said drive means includes clutch means to permit lost motion between the drive means and the movable bridge portion as the movable bridge portion engages said mechanical stop limit means in either said up or down positions of the bridge portion.

3. The accessory of claim 2 wherein said cam means is driven by said clutch means so that at the end of travel of said movable bridge portion the sounding means is inoperative when said drive means is energized.

4. The accessory of claim 1 wherein said circuit means is operatively connected to said bridge portion by a double-pole switch, said double-pole switch including an arcuate contact portion of predetermined length which energizes the first power supply rail segment in the bridge down position and energizes the second power supply rail segment in the bridge up position and maintains both said first and second power supply rail segments de-energized during substantially the entire period of movement of the bridge portion between its respective up and down positions.

5. A bridge accessory for use with a model vehicle set having an electrically conductive track layout for defining a path of travel and supplying power to the model vehicle, and including at least one cross-over point in the track layout, comprising:

a frame structure at the cross-over point;

a bridge portion including a movable track segment pivotally mounted on the frame, said bridge portion being movable between a down position where the model vehicle may pass over the bridge portion and an up position where the model vehicle may pass under the bridge portion;

a selectively operable drive means connected to the movable bridge portion and a power supply for selective movement of the bridge portion between its respective up and down positions;

circuit means operatively connected to said bridge portion including at least one power supply rail and at least one ground rail on the track and insulation means for a first power supply rail segment of predetermined length on the track segment on the movable bridge portion and a second power supply rail segment of predetermined length on the track layout under the cross-over point for insulating said first and second power supply rail segments from the remainder of the track layout power supply rail, said circuit means alternately connecting said power supply for energizing the first insulated power supply rail segment on the top of the movable bridge portion when the bridge is in its down position and the second insulated power supply rail segment under the cross-over point when the bridge is in its up position, said circuit means being operatively connected to said bridge portion by a double-pole switch, said double-pole switch including an arcuate contact portion of predetermined length which energizes the first power supply rail segment in the bridge down position and energizes the second power supply rail segment in the bridge up position and maintains both said first and second supply rail segments de-energized during substantially the entire movement of the bridge portion between its respective up and down positions.

6. The accessory of claim 5 including mechanical stop limit means defining the up and down positions of the movable bridge portion and wherein said drive means includes clutch means to provide lost motion between the drive means and the movable bridge portion as the movable bridge portion engages said mechanical stop limit means in either said up or down position of the bridge portion.

* * * * *